US008671924B2

(12) United States Patent
Hpward

(10) Patent No.: US 8,671,924 B2
(45) Date of Patent: Mar. 18, 2014

(54) BOW LIMB AND CAM STRIKE PLATE

(76) Inventor: Robert Scott Hpward, Jacksonville, FL (US)

( * ) Notice: Subject to any disclaimer, the term of this patent is extended or adjusted under 35 U.S.C. 154(b) by 155 days.

(21) Appl. No.: 13/506,648

(22) Filed: May 7, 2012

(65) Prior Publication Data

US 2013/0291850 A1 Nov. 7, 2013

(51) Int. Cl.
*F41B 5/14* (2006.01)

(52) U.S. Cl.
USPC ..... 124/25.6; 124/86

(58) Field of Classification Search
USPC ..... 124/25.6, 86
See application file for complete search history.

(56) References Cited

U.S. PATENT DOCUMENTS 4,979,488 A 12/1990 Fenton et al.
6,216,680 B1 * 4/2001 Sanders ..... 124/86
D530,387 S * 10/2006 Kennedy ..... D22/107
D568,435 S * 5/2008 Delprete ..... D22/107
7,730,883 B2 6/2010 Lawson et al.

* cited by examiner

*Primary Examiner* — John Ricci
(74) *Attorney, Agent, or Firm* — Jeffrey R. Tyer

(57) ABSTRACT

The apparatus disclosed begins exterior of archery bow stave cam slot and traverses a generally elliptically ovidly path concaved inward and roughly shaped paralleling exterior perimeter edge movement of the take up track of an elliptically ovid cam module and idler module; and a portion of the apparatus is formed to terminate at the power and buss cable's contact point on the take-up track of the cam module and idler module without interference of the aforementioned. Said apparatus additionally is shaped cross sectionally in a manner that shields said power and buss cable's contact point on said take-up track of the cam module and idler module. In addition said apparatus is able to be canted to change apparatus chord angle relationship to archery bow's chord angle; and to aid in tilling said archery bow.

5 Claims, 4 Drawing Sheets

BOW LIMB AND CAM STRIKE PLATE

CROSS REFERENCE TO RELATED APPLICATIONS

This application claims the benefit of U.S. Provisional Application No. 61/465,376 filed Mar. 18, 2011, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates generally to the U.S. patent classification definitions technical field of but not limited to; Class 273 Archery/Subclass 317+ and Class 124 Mechanical guns and projectors/subclass 23.1 bow, subclass 25 crossbow, subclass 25.6 compound bow, and more specifically to a unique and novel apparatus that provides protection to such as but not limited to, an archery bow's cam module, idler module, tension cable and string; and provides protection to stave reel, cam and idler modules, wheel etc. which are mounted at or near the extreme end of a bow stave from contact with objects which would cause damage to the aforementioned.

2. Prior Art

Archery in its purest form has long been associated with the Native American bow and arrow, and while the newest style of bow is the compound bow, it was invented in the mid-20th century with $20^{th}$ century technology. Said compound bow consisted of steel pulleys and/or cams on the ends of the staves, with a long string that criss-crosses the bow multiple times. One limb usually has an elliptical cam, which produces a sudden reduction in the draw weight of the bow when a certain point is reached. Another form had double elliptical cams but had timing problems. Bow material was commonly wood or fiberglass. Computer software had yet to be invented that could demonstrate stress and g-force generated upon staves, strings and elliptical pulleys. Arrow speed was comparably slow at 200 fps and archery bows had a typical "C" shape. Typically archery bows described can be bought in expensively.

In the $21^{st}$ century, computers and software technology have advanced archery as archery equipment has seen dramatic advances in aluminum and magnesium composite limb systems, parallel limb design, limb turrets, cam module, idler module, carbon tension cable and strings, power and buss cables, cable and string suppressors, inertia tungsten carbide weight disks embedded into cams and string grubs. The aforementioned advances and innovations have brought the modern compound bow to where it is today. Arrow speeds now reach 340 fps; computerized numerical controlled machines bend, form or vacuum composite material into variations of rectangular shapes with beyond parallel dual limbs tipped with cam modules, idler modules, string suppressors etc.

While archery equipment and compound bow performance advances have continued to rise, so has the price of this $21^{st}$ century technology. High performance archery bows cost upwards of $1,200. While there do exist many fanciful apparatus that will attach in all manners to an archers bow, they all have similar shortcomings which is none would provide adequate protection to said new and expensive $21^{st}$ century archery technology. Specifically the cam module and idler module elliptically ovidly shaped cams and associated power and buss cable's contact point on the take-up track of the cam without interfering with the aforementioned module(s) movement or sacrificing somewhere else.

For example, U.S. Pat. No. 7,730,883 discloses a bow cam protector that overlaps the cam with members extending beyond the cam . . . . While such a configuration may be suitable for providing limited cam protection, vibration dampening and a stand, the invention of the '883 patent does not provide protection to either said cam module and idler module elliptically ovidly shaped cams or associated power and buss cable's contact point on the take-up track of the cam. Also '883's said members extending beyond the cam could act as an undesirable hook while walking through thick forest while hunting.

U.S. Pat. No. 4,979,488 discloses a cam or eccentric wheel shield that quiets the sound of . . . and shields the movement of cams or a-centric wheels during movement and protects the wheels and the cable from becoming clogged, chipped or damaged. Disclosure of '488 is unique to $20^{th}$ century archery equipment but does not address the use of or the acceptance of $21^{st}$ century archery technology such as offset cam modules, idler module, string and cable suppressors or grubs. So also, said patent 488 is unlikely to withstand the g-force vibrations and recoil associated with $21^{st}$ century high performance archery bows. In addition, '488 interferes and blocks the mounting points for some string suppressors which are sold as stock equipment. '488 interferes with cam module and idle module field adjustments.

Accordingly, a need remains for BOW LIMB AND CAM STRIKE PLATE in order to overcome the above-noted shortcomings. The non-limiting exemplary embodiments satisfies such a need by providing an apparatus that is convenient and easy to use, lightweight yet durable in design, versatile in its applications, and designed for easily and conveniently protecting cam module and idler module elliptically ovidly shaped cams and associated power and buss cable's contact point on the take-up track of the cam.

BRIEF SUMMARY OF THE INVENTION

In view of the foregoing background, it is therefore an object of the non-limiting exemplary embodiments to provide a brief summary of the invention and some of the advantages such as provides protection to: an archery bow's cam module, to the idler module, tension cable and string; provides protection to stave reel, cam, wheel etc. which are mounted at or near the extreme end of a bow stave. Another advantage is protection from contact with objects which would cause damage to the associated power and buss cable's contact point on the take-up track of the cam.

Described in one embodiment is the non-snag x-axis and y-axis shaped generally parallel, slightly curving inwardly, but not encompassing, elliptically ovidly shape.

An additional embodiment of the invention describes the apparatus as situated neither to extend into the cam module nor the idler module swing perimeters.

Yet in another embodiment to align no further outwardly then to said associated power and buss cable's contact point on the take-up track of the cam.

A cantably threaded fastening system is described in another embodiment of the invention.

In still another embodiment is attaching by such as but not limited to, a threaded fastener through either the respective cam module slot or the respective idler module slot.

This invention BOW LIMB AND CAM STRIKE PLATE does not interfere with field adjustments to neither the cam module nor the idler module.

These and other objects, features, and advantages of the invention are provided by description of the preferred embodiments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
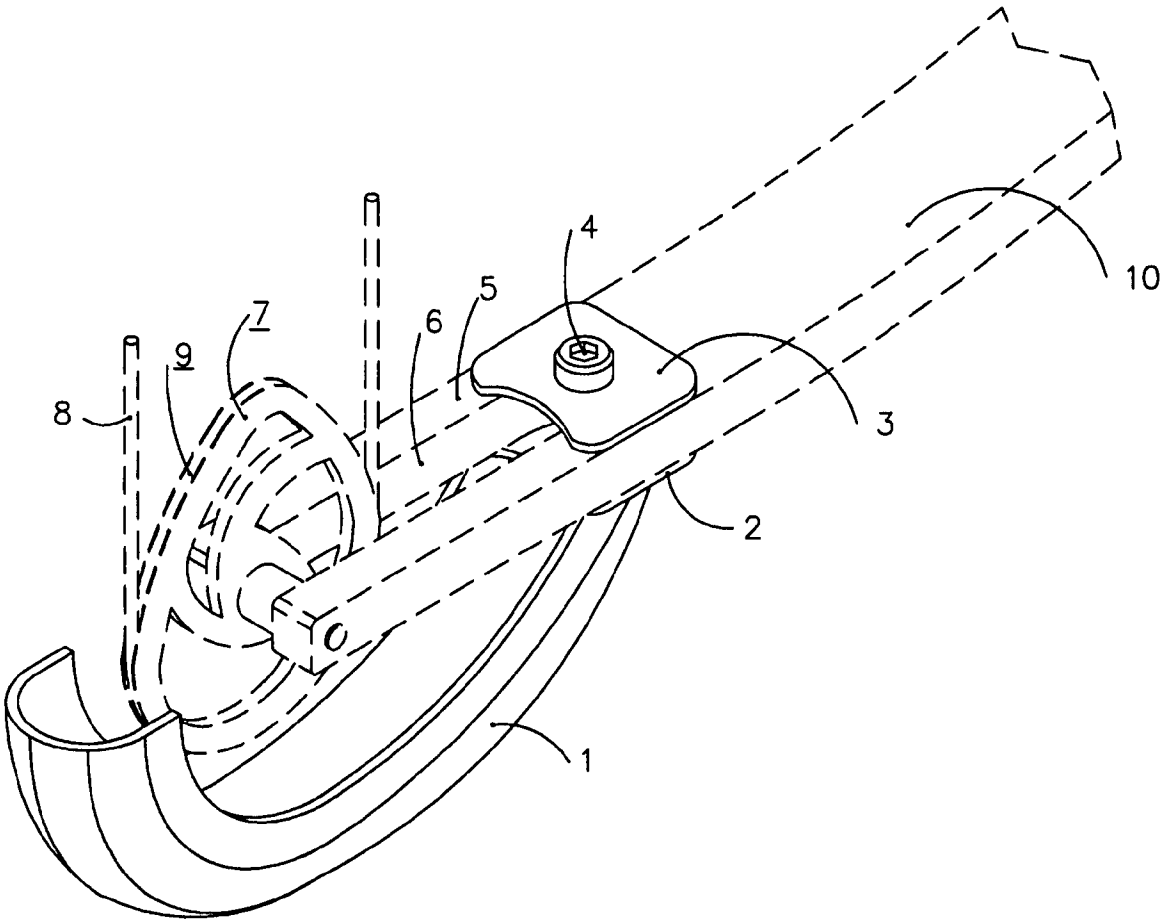
FIG. 1 is a perspective view showing BOW LIMB AND CAM STRIKE PLATE, in a preferred use installed on a compound bow stave and in accordance with the non-limiting exemplary embodiments.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The non-limiting exemplary embodiments will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "non-limiting exemplary embodiments" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the non-limiting exemplary embodiments. Thus, to the maximum extent allowed by law, the scope of the non-limiting exemplary embodiments is to be determined by the broadest permissible interpretation of the following claims and their equivalents, and shall not be restricted or limited by the foregoing detailed description.

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "non-limiting exemplary embodiment" in various places in the specification are not necessarily all meant to refer to the same embodiment.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The apparatus of this invention is referred to generally in FIG. 1/4 and is intended to provide a perspective view showing BOW LIMB AND CAM STRIKE PLATE attached to a common 21$^{st}$ century high performance compound bow. It should be understood that the non-limiting exemplary embodiments may be used to describe similar apparatus and many different types of devices that could be protected by BOW LIMB AND CAM STRIKE PLATE and should not be limited to the uses described herein. The descriptor nomenclature legend that follows is not meant to be all encompassing but to aid the reader in understanding the figures within the drawings.

Item Number 1: Strike Plate;
Item Number 2: Cantable mounting plate;
Item Number 3: Cam module slot mounting plate;
Item Number 4: Threaded fastener;
Item Number 5: Stave end;
Item Number 6: Cam module slot (mirror Idler module lot);
Item Number 7: Cam module;
Item Number 8: Power and buss cable;
Item Number 9: Take-up track of the cam;
Item Number 10: Bow Stave.

Viewing FIG. 1/4, a perspective view, BOW LIMB AND CAM STRIKE PLATE is shown with descriptors number 1 thru 10 illustrating a first embodiment of the invention. BOW LIMB AND CAM STRIKE PLATE is constructed of an archedly ridged material that withstands shock g-force delivered from a recoiling archery compound bow. The 1 strike plate is situated peripherally to 7 cam module and/or respectively to the idler module (mirrored and not shown), and is mounted at or near 5 stave end and the extreme end of 10 bow stave with 2 cantable mounting plate exterior 6 Cam module slot or idler module (mirrored and not shown), sandwiching 10 bow stave, at a position in the 6 cam module slot with 3 cam module slot mounting plate internal by use of a fastener such as but not limited to 4 threaded fastener. Said 1 strike plate and 2 cantable mounting plate are circumscribed about the power stroke and swing radius of the said 7 cam and idler module thus do not extend into the 7 cam module nor the mirrored and not shown idle module Yet in another embodiment and still viewing FIG. 1/4, said 1 strike plate begins near the crotch of the 6 cam module slot and sweeps concavely about an intersecting radial center point proximate center line of 10 bow stave from bow and said concave sweep terminates prior to 8 power and buss cable's contact point on the 9 take-up track of the 7 cam module or idler module (mirrored and not shown).

A further embodiment also viewed on FIG. 1/4, is 2 cantable mounting plate designed to allow numerous variations in tiller adjustment of the bow. When said 2 cantable mounting plate is tilted or angled exterior the 5 stave end, a change in the relationship between the chord of the bow and the cord of the 1 strike plate results. This relationship allows the user to position the 1 strike plate nearer to or further from the 7 cam module and respective idler module.

An additional embodiment viewed on FIG. 1/4, 1 strike plate is shaped in an elliptical ovid shape paralleling the 7 cam module and respective idler module and does not interfere with field adjustments to either the 7 cam module nor the idler module.

Figure 2:
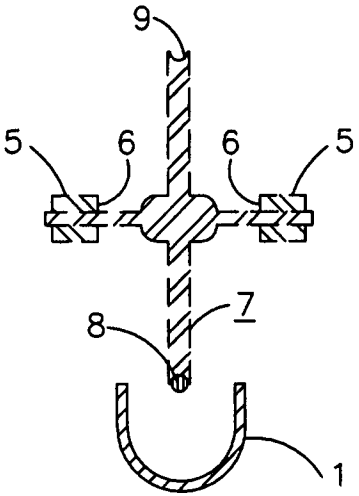
FIG. 2 is a cross-sectional view showing the x-axis characteristic.

Viewing FIG. 2, cross-sectional view showing the x-axis characteristic and the reader can see a cross section of 1 strike plate. This embodiment describes 1 strike plate as having at least one symmetrical opposed surfaces which tangentially intersect a ovidly shaped semi-circle; where said symmetrical opposed surfaces are disposed a vertical distance away from 7 cam module and 8 power and buss cable thus a void is between the aforementioned and 1 strike plate.

Additional embodiments viewed on FIG. 2, 1 strike plate having a radial mid-point of said ovidly shaped semi-circle perimeterly disposed a distance away from the 9 take up track of the 6 cam module allows a void between the aforementioned and 1 strike plate.

Figure 3:
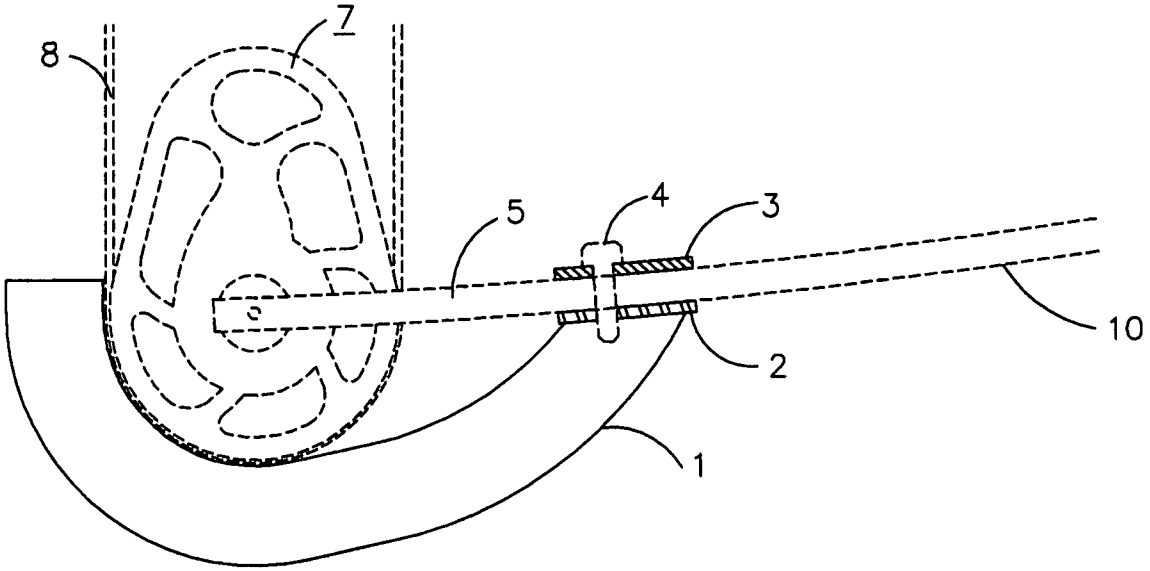
FIG. 3 is a cross-sectional view showing the y-axis characteristic.

In an alternate embodiment, viewing FIG. 3, cross-sectional view showing the y-axis characteristic and the reader can see interior edge of 1 strike plate relationship to the exterior edge of 8 power and buss cable. Said relationship sweeps elliptically ovid and concavely shaped and by adjusting the distance relationship of 4 threaded fastener in the crotch of 6 cam module slot, various outside diameter, elliptically ovidly shaped cams, wheels, pulleys etc are accommodated within the 6 cam module or idler module slot.

Figure 4:
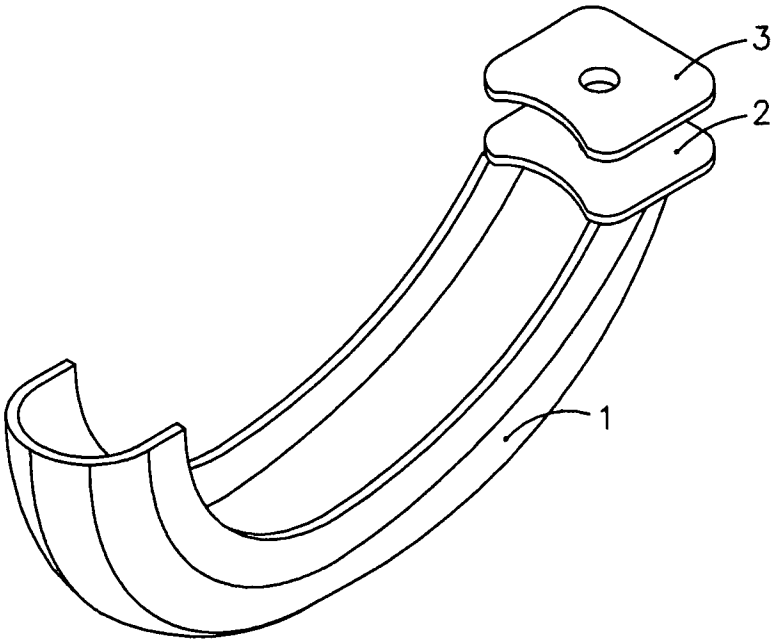
FIG. 4 is a perspective of the BOW LIMB AND CAM STRIKE PLATE.

FIG. 4 is a perspective of the BOW LIMB AND CAM STRIKE PLATE included for clarity.

Such a structural configuration provides the unexpected and unpredictable advantage of x-axis and y-axis rigidity while also providing protection to such as but not limited to, an archery 6 cam module's and idler module's elliptically ovidly shaped cam(s) and associated 8 power and buss cable and contact point on the 9 take-up track of the 6 cam module without interfering with neither said module(s) movement, said power and buss cable nor said take up track of cam.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the non-limiting exemplary embodiments may include variations in size, materials, shape, form, function and manner of operation.

What is claimed as new and what is desired to secure by Letters Patent of the United States is:

1. A sweeping elliptically ovidly and inwardly concavedly shaped BOW LIMB AND CAM STRIKE PLATE apparatus cantably mounted at or near the exterior extreme end of a bow stave for protecting an elliptically ovidly shaped bow stave reel, cam module, idler module, associated power and buss cable and contact point on the take-up track of the cam module and idler module without interfering with either said module(s) movement, said power and buss cable nor said take up track of cam module or idler module comprising:

an apparatus situated peripherally to cam module and/or respectively idler module and cantably mounted at or near bow stave end, sandwiching a bow stave at a position relative cam module slot with cam module slot mounting plate by use of a threaded fastener, however many fastening apparatus could be used; and begins near the crotch of the cam module slot and sweeps concavely about an intersecting radial center point proximate center line of bow stave from bow and said concave sweep terminates prior to power and buss cable's contact point on the take-up track of the cam module or idler module.

2. The apparatus of claim 1, wherein said cantably mounted plate allows tiller adjustment of the bow; and positions the strike plate nearer to or further from the cam module and respective idler module.

3. The apparatus of claim 1, wherein said strike plate is shaped in an elliptical ovid shape and closely parallels said cam module and respective idler module.

4. The apparatus of claim 1, wherein said strike plate has an x-axis characteristic cross section having at least one symmetrical opposed surfaces which tangentially intersect a ovidly shaped semi-circle; and where said symmetrical opposed surfaces are disposed a vertical distance away from cam module; and a vertical distance away from said power and buss cable thus a void is between the aforementioned and strike plate; and wherein said strike plate having a radial mid-point of said ovidly shaped semi-circle perimeterly disposed a distance away from the take up track of the cam module allows a void between the aforementioned and strike plate.

5. The apparatus in claim 1, wherein said strike plate has a y-axis characteristic cross section which sweeps elliptically ovidly and inwardly concavely shaped; and wherein adjusting the distance relationship of threaded fastener and the crotch of said cam module slot, various outside diameter, elliptically ovidly shaped cams, wheels, pulleys etc are accommodated within the cam module or idler module slot.

* * * * *